US006474564B2

(12) United States Patent
Doshay et al.

(10) Patent No.: US 6,474,564 B2
(45) Date of Patent: Nov. 5, 2002

(54) TARGETING, SMALL WILDLAND FIRE EXTINGUISHER DROPPING SYSTEM

(76) Inventors: Irving Doshay, 380 Surfview Dr., Pacific Palisades, CA (US) 90272; Max N. Alper, deceased, late of Los Angeles, CA (US), by Floss Alper, executrix ( * ) Notice: Subject to any disclaimer, the term of this patent is extended or adjusted under 35 U.S.C. 154(b) by 0 days.

(21) Appl. No.: 09/765,909

(22) Filed: Jan. 19, 2001

(65) Prior Publication Data

US 2001/0032724 A1 Oct. 25, 2001

Related U.S. Application Data

(60) Provisional application No. 60/179,357, filed on Jan. 31, 2000.

(51) Int. Cl.[7] ..... A62C 2/00; A62C 3/00; A62C 8/00; A62C 25/00

(52) U.S. Cl. ..... 239/46; 239/43; 239/36; 239/53

(58) Field of Search ..... 169/46, 43, 36, 169/53, 85, 83, 78, 79, 80, 82

(56) References Cited

U.S. PATENT DOCUMENTS

| | | | | | |
|---|---|---|---|---|---|
| 2,359,573 | A | * | 10/1944 | MacKay | 169/36 |
| 2,633,920 | A | * | 4/1953 | Carlson | 169/36 |
| 3,770,059 | A | * | 11/1973 | Graham | 169/1 A |
| 4,124,049 | A | * | 11/1978 | Yamaguchi | 150/5 |
| 4,285,403 | A | * | 8/1981 | Poland | 169/28 |
| 5,778,984 | A | * | 7/1998 | Suwa | 169/36 |
| 6,125,942 | A | * | 10/2000 | Kaufman et al. | 169/53 |

* cited by examiner

*Primary Examiner*—Henry C. Yuen
*Assistant Examiner*—Davis Hwu
(74) *Attorney, Agent, or Firm*—Norton R. Townsley; Belasco Jacobs & Townsley, LLP

(57) ABSTRACT

A targeting, small wildland fire extinguisher dropping system comprising: a droppable extinguisher package, adapted for filling and handling, for containing fire suppressant solution, and bursting when it hits a target on the ground full of said fire suppressant solution and dropped from a height; a quantity of fire suppressant solution inside said droppable extinguisher package; and a package dispenser, adapted for suspending, for holding said droppable extinguisher package and dropping said droppable extinguisher package upon command. A stirrer adapted to be inserted into said droppable extinguisher package for stirring said fire suppressant solution may also be provided.

18 Claims, 5 Drawing Sheets

TARGETING, SMALL WILDLAND FIRE EXTINGUISHER DROPPING SYSTEM

CROSS REFERENCES

The Applicants claim the benefit of Disclosure Document No. 431,309 filed Jan. 12, 1998 and their Provisional Application, Serial No. 60/179,357, filed Jan. 31, 2000. The disclosure of U.S. patent application Ser. No. 09/271,626 is also hereby incorporated by reference.

BACKGROUND OF THE INVENTION

The present invention relates to the field of fire suppression and more particularly to a system for dropping packages of fire extinguisher materials which are designed to burst and spray fire suppressant over a limited target area upon impact.

Currently fire suppressant or retardant is dropped on or in front of established fires by aerial tanker, which can be either a fixed wing aircraft (e.g. what is popularly known as a "superscooper") or a helicopter. The tanker includes a tank with bottom opening doors. In fixed wing aircraft, the tank is filled with fire retardant or suppressant solution while the doors are closed. Then the tanker is flown to a strategically selected location over the fire. Finally, the doors are opened which allows the fire retardant or suppressant solution to fall under the influence of gravity. Helicopters carry a bucket suspended underneath by a cable with the ability to spill the suppressant, upon command from the cockpit, onto the area near the fire.

Newly developed wildland fire fighting systems will allow these fires to be detected at inception. See U.S. patent application Ser. No. 09/271,626. Then fire suppression must be administered with great accuracy. This new method of fighting small wildland fires will require a fire suppressant capability which: 1) can contain a droppable suppression package, 2) can be rapidly replenished, 3) can be easily loaded into or suspended from an aerial fire suppression vehicle, 4) has a refillable suppression package that is droppable at will from the fire suppression vehicle, and 5) is able to target fire suppressant onto an identified, limited area.

Development of a fire suppressant system which: 1) can contain a droppable suppression package, 2) can be rapidly replenished, 3) can be easily loaded into or suspended from an aerial fire suppression vehicle, 4) has a refillable suppression package that is droppable at will from the fire suppression vehicle, and 5) is able to target fire suppressant onto an identified, limited area represents a great improvement in the field of fire suppression and satisfies a long felt need of wildland fire fighting services.

SUMMARY OF THE INVENTION

The present invention is a fire suppressant droppable package/package dispenser which: 1) can contain a droppable suppression package, 2) can be rapidly replenished, 3) can be easily loaded into or suspended from an aerial fire suppression vehicle, 4) has a refillable suppression package that is droppable at will from the fire suppression vehicle, and 5) is able to target fire suppressant onto an identified, limited area.

The basic invention is a remotely controllable extinguisher dispenser that can be refilled with a droppable extinguisher package. One embodiment of his invention comprises: a housing; a top plate with a central hole across the top of the housing; a bag, with a neck made to fit inside the hole, made of pliable material, designed to contain fire suppressant solution, fit snugly yet freely inside the housing when full, and burst when it hits the ground and dropped from a height; a quantity of fire suppressant solution inside the bag; a bottom plate, hingeably attached to the bottom of the housing; a suspending mechanism for suspending the housing; a latch for releasably latching the bottom plate in a closed position; a latch release moveably attached to the latch and the housing; a lid, sized to fit inside the neck, with a handle and a threaded loading port through it firmly assembled inside the neck; a threaded closure, adapted to be inserted into and removed from the threaded loading port; and a securing mechanism, attached to the top plate adjacent the hole, designed to hold the neck/lid assembly when the first bag is full of fire suppressant solution and the bottom plate is latched closed and to release the neck/lid assembly when the bag is full of fire suppressant solution and the bottom plate is open.

In this first embodiment, the extinguisher package comprises: the bag, filled with a quantity of fire suppressant solution; the lid; and the threaded closure; and the package dispenser comprises: the housing; the top plate; the bottom plate; the suspending mechanism; the latch; the latch release; and the securing mechanism.

A second embodiment of this invention also includes: a first valved port, passing through the lid and pressurized gas inside the bag.

A second embodiment of this invention also includes: a second valved port passing through the lid; a second bag having a neck and made of pliable material, smaller than the first bag, located inside the first bag; the neck of the second bag being attached to the interior portion of the second valve; pressurized gas inside the second bag; and sharp point(s) attached to the interior of the first bag.

Also provided with this invention may be a stirrer adapted to be inserted into the first bag through the threaded opening. The threaded opening may be canted to allow the stirrer to clear the second bag.

An appreciation of the other aims and objectives of the present invention and an understanding of it may be achieved by referring to the accompanying drawings and description of a preferred embodiment.

DETAILED DESCRIPTION OF THE PREFERRED EMBODIMENT

Figure 1:
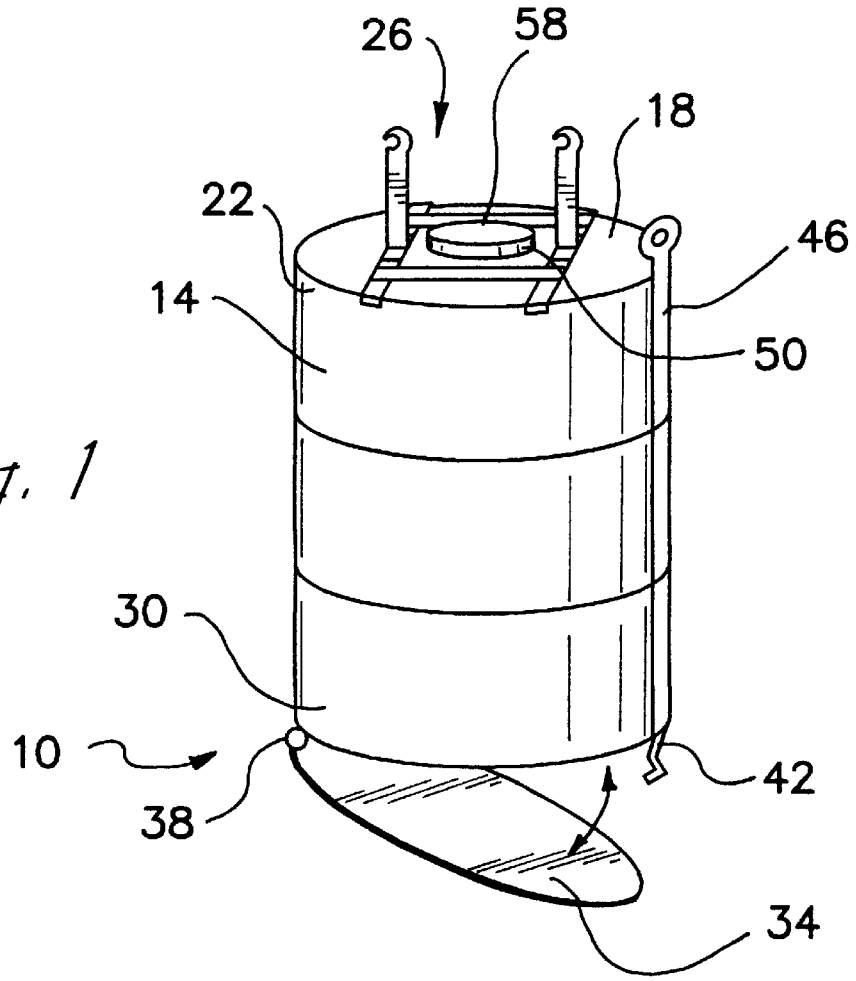
FIG. 1 is a three dimensional, exterior view of the fire suppressant package dispenser of this invention showing the extinguisher dispenser, partially open, and the package bag lid.

FIG. 1 is a three dimensional, exterior view of the targeting, small wildland fire extinguisher dropping system 10 of this invention, partially open. The dispenser housing 14 is essentially cylindrical and hollow with a top plate 18 affixed to and closing its top 22. A suspending mechanism 26, which allows for the targeting, small wildland fire extinguisher dropping system 10 to be handled, and loaded into or suspended from an air vehicle, is attached to the dispenser housing 14. At the bottom 30 of the housing 14, the bottom plate 34 is attached by a hinge 38. A latch 42 enables keeping the bottom plate 34 in the closed position. A latch opening mechanism 46 is attached to the latch 42 and the housing 14 in order to enable remote operation of the latch 42. Attached, approximately centrally to the top plate 18, is a securing mechanism 50. A bag/lid assembly 54 is secured within the securing mechanism 50. Only the lid portion 58 of the assembly 54 is visible in the view shown on FIG. 1. The function and construction of the securing mechanism 50 and lid 58 will become apparent from descriptions below.

While the housing 14 shown on FIG. 1 is a typical 55 gallon drum, made of steel, it will be apparent to those most familiar with the technology which this invention pertains that other dispenser styles, designs and materials of housing 14 could easily be used.

Figure 2:
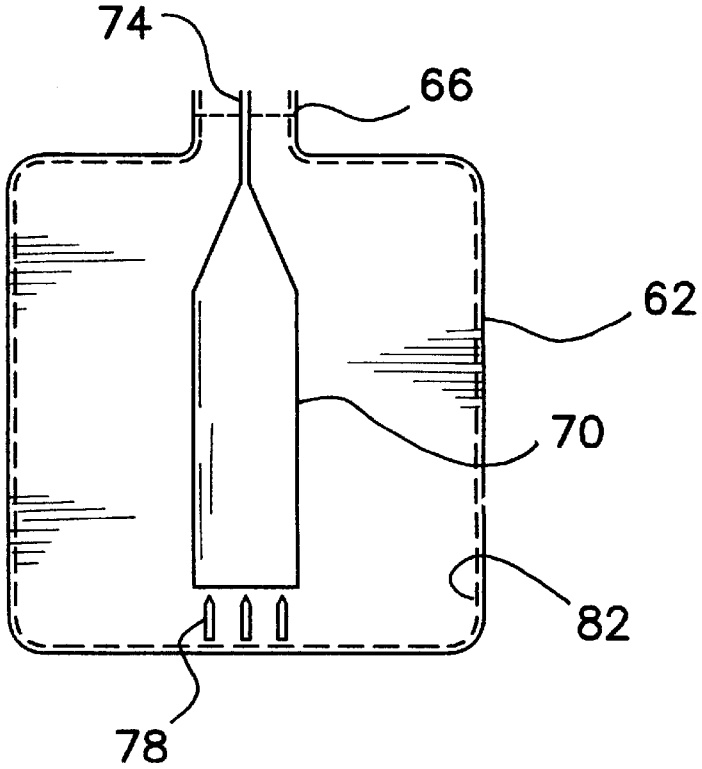
FIG. 2 is a cross-sectional view of two embodiments of the package bag which goes inside the extinguisher dispenser illustrated on FIG. 1.

FIG. 2 is a cross-sectional view of the package bag 62 of this invention. This bag 62 is made of flexible material which is compatible with the desired fire suppressant solution, such as metallized Mylar®. It is constructed so that it will fit inside the housing 14 with a close but free fit so that, when the bag 62 is fall of the fire suppressant solution, it will slide easily out of the housing 14. The bag 62 has a neck 66 and is designed so that, when full of solution and dropped from a height, it will burst when it hits the target, which is on the ground. Such a design may be achieved by appropriately weakening or scoring the bag 62 at strategic locations.

FIG. 2 also illustrates an alternate embodiment of this invention 10. Inside the first bag 62 is second, smaller bag 70. This second bag 70 is designed and constructed similarly to the first bag 62. The second bag also has a neck 74. However this second bag 74 is designed to be filled with a compressed gas, such as carbon dioxide, air, or nitrogen. To insure that this second bag 74 ruptures when the first bag 62 hits the ground, one or more sharp points 78 is attached to the inside 82 of the first bag 62 at strategic locations.

Figure 3:
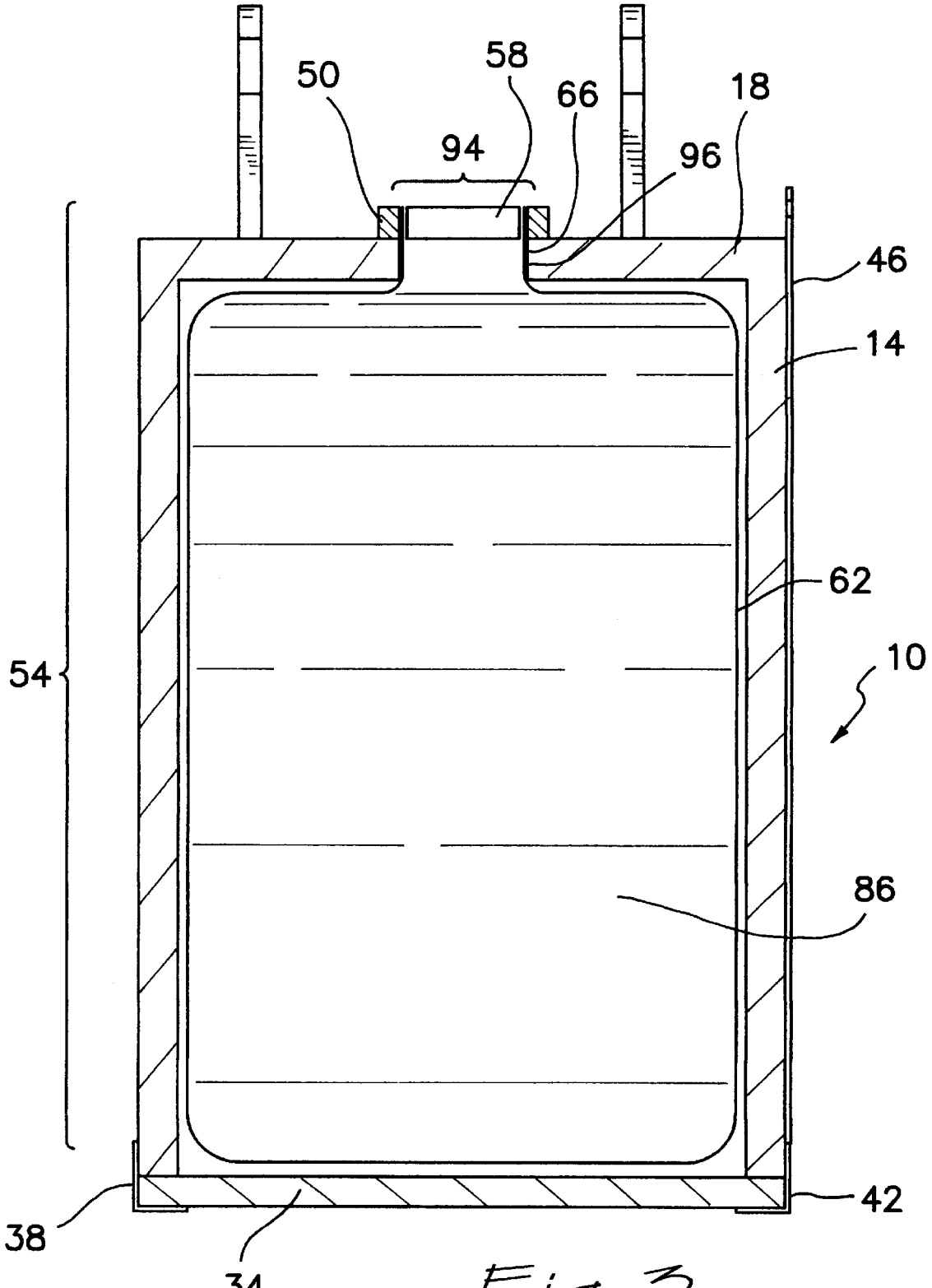
FIG. 3 is a cross-sectional schematic of the fully assembled invention.

FIG. 3 is a cross-sectional schematic of one embodiment of a fully assembled targeting, small wildland fire extinguisher dropping system 10 of this invention. The first bag 62 is inserted in the dispenser housing 14, the bottom plate 34 is in the latched closed position, and the first bag 62 is full of the selected fire suppressant solution 86. The neck 66 of the bag 62 is assembled to a lid 58. The neck/lid portion 94 of the bag/lid assembly 54 fits closely but freely through an opening 96 in the top plate 18 and is retained with a securing mechanism 50. The function of the securing mechanism 50 is to hold the filled bag 62 within the housing 14 when the bottom plate 34 is latched closed but to release the bag 62 fall of fire suppressant solution 86 when the bottom plate 34 is open.

Figure 4:
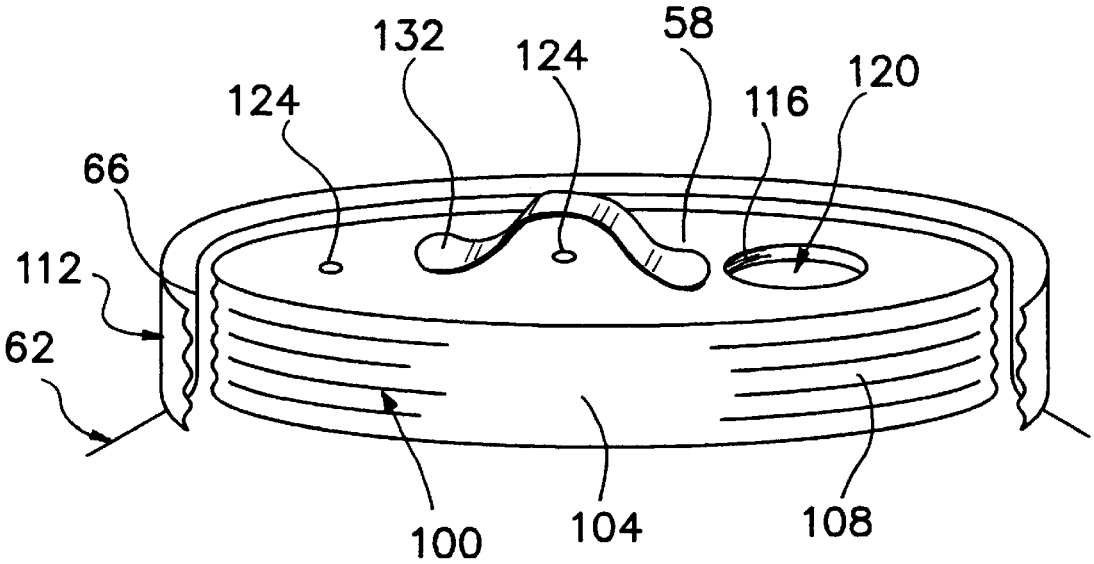
FIG. 4 is a partially cut away, exploded view illustrating assembly of the package bag and bag lid.
Figure 5:
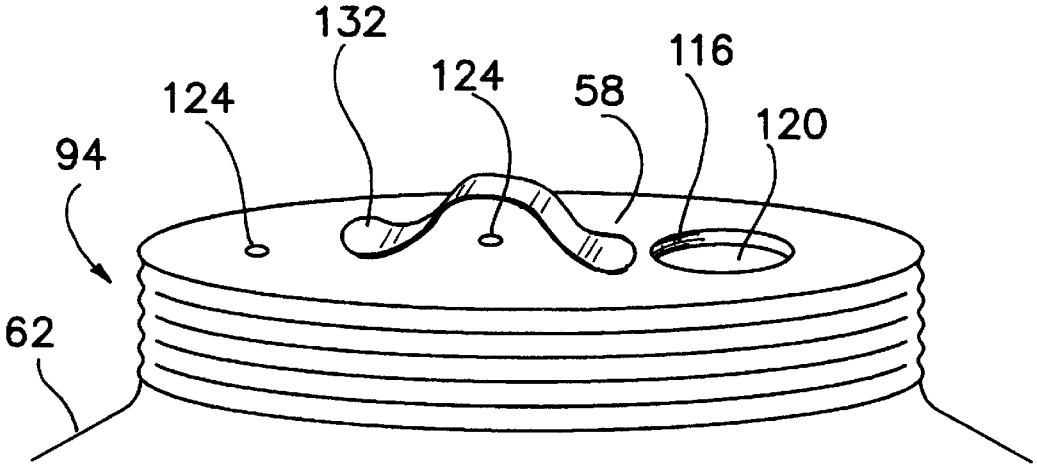
FIG. 5 is a partial, exterior, three dimensional view of the assembled package bag and lid.

FIG. 4 is a partially cut away, exploded view illustrating assembly of the bag 62 and bag lid 58. The lid 58 is fairly thick and has annular grooves 100 in its circumference 104. This circumference 104 is coated with a thermosetting adhesive 108 and the lid 58 placed within the neck 66. A shrink fit band 112 is then the placed around the neck 66. Finally, hot air is applied to the shrink fit band 112 in order to shrink the band 112 and cure the adhesive 108. The assembly 94 will then look as illustrated in FIG. 5. FIGS. 4 and 5 illustrate a preferred method for assembling the lid 58 to the neck 66 of the bag 62. It will be apparent to those to whom this invention is most familiar, that other assembly methods can be devised.

There is a filling port 116 through the lid 58. This port 116 is preferably threaded and can be closed with a mating closure 120. The port 116 and closure 120 are similar to the gasoline filling mechanisms of automobiles. Of course, alternatives to threaded ports and closures exist and could easily be substituted. There may be one or two more holes 124 through the lid 58. These are for installation of optional gas filling valves 128, 130 (see FIG. 8) which are just like valves used for filling tires. There is also a handle 132 on the lid 58 to facilitate handling of the unfilled bag/lid assembly 54.

Figure 6:
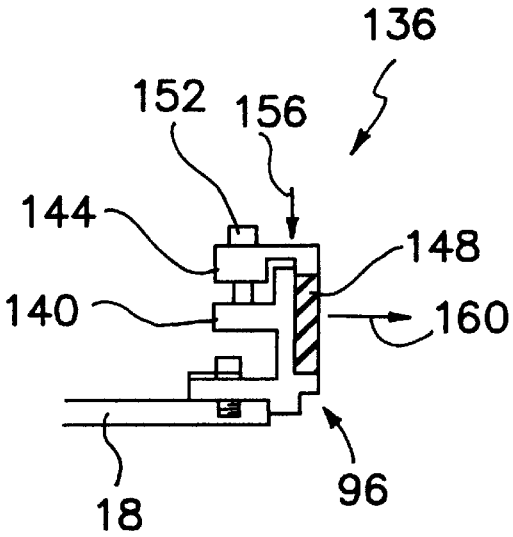
FIG. 6 is a cross-section of a typical dispenser lid mounting assembly.

FIG. 6 is a cross-section of a typical neck/lid mounting assembly 136. This assembly is made from several pieces of metal extrusion 140, 144, of specific cross-section as shown on FIG. 6, and a band of elastomer 148 connected together with a tightening screw 152, as illustrated on FIG. 6. When the tightening screw 152 is tightened in the direction of the first arrow 156, the elastomer bulges outward in the direction of the second arrow 160. The assembly 136 is fastened to the top plate 18 adjacent the opening 96. It will readily be appreciated that, when the neck/lid assembly 94 is adjacent to this mounting assembly 136, tightening the screw 152 will retain the neck/lid assembly 94 within the mounting ring 136 with a specific amount pressure. The pressure is selected so that the filled bag 62 stays within the housing 14 when the bottom plate 34 is latched closed, but slides out when the bottom plate 34 is open. Although the neck/lid mounting assembly 136 is illustrated on this and other Figures as being continuous and circular, it could be comprised of arcuate segments. Clearly, again, other methods of insuring that the filled bag 62 stays within the housing 14 when the bottom plate 34 is latched closed but slides out when the bottom plate 34 is open, can be devised.

Figure 7:
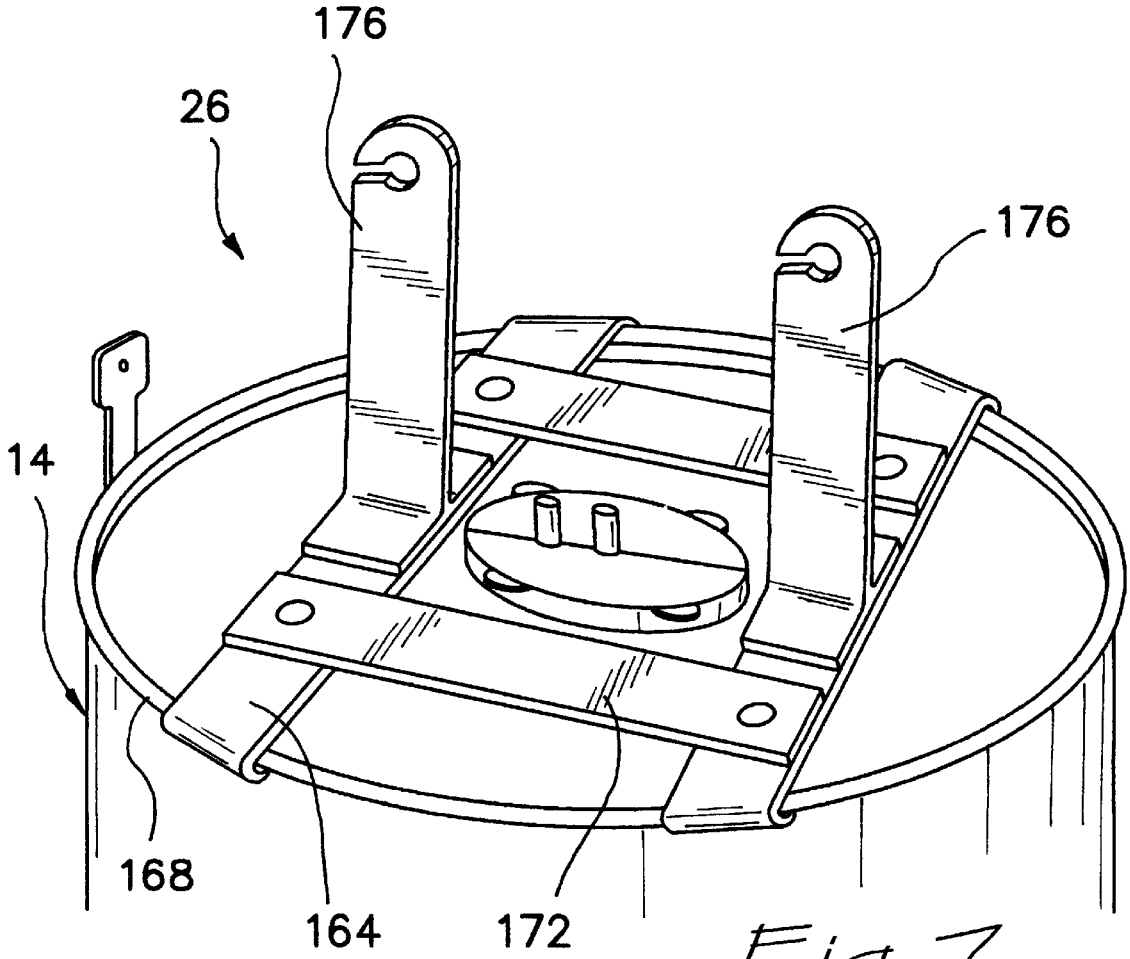
FIG. 7 is a partial, three-dimensional view of the top of the invention, illustrating in greater detail a typical suspending mechanism.

FIG. 7 is a partial, three-dimensional view of the top of the dispenser housing 14, illustrating in greater detail a typical suspending mechanism 26. This mechanism 26 is designed for the case when the housing is a 55 gallon drum and consists of: several straps 164, which curl around the rim 168 of the drum; several cross straps 172, which hold the straps 164 in a particular relationship; and several hanger bars 176, which are attached to and project vertically from the straps 174. Clearly, again, other designs of suspending mechanism 26 would work equally well and may be necessary with other designs of housing.

Figure 8:
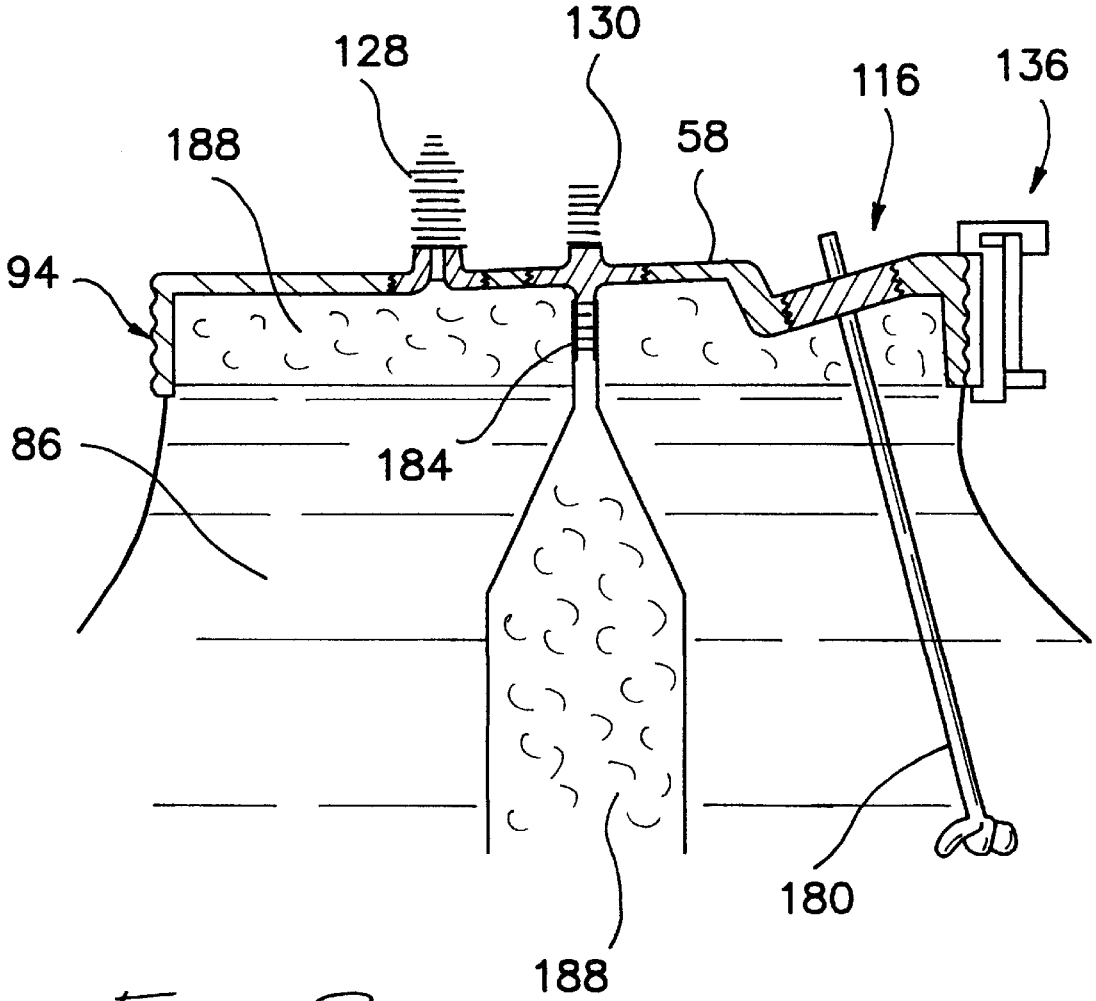
FIG. 8 is a partial cross-sectional view through a package lid, illustrating several embodiments of the invention and its solution mixing capability.

FIG. 8 is a partial cross-sectional view through a bag/lid assembly 54, illustrating several embodiments of the invention 10 and its solution mixing capability. In case the fire suppressant solution 86 settles during storage, a propeller 180 designed to fit through the filling port 116 is provided. The propeller 180 can be rotated from the outside by motor in standard fashion.

The optional first valve 128 may be installed in order to allow pressurization with compressed gas 188 when the fire suppressant solution 86 is contained within the first bag 62. The purpose of the pressurization is to increase the spread of the fire suppressant solution 86 when the bag 62 bursts upon impact with the target.

The second bag 70, if used, is attached to the inner portion 184 of the second optional valve 130. It is then pressurized with compressed gas 188. When the first bag 62 hits the target, the sharp point(s) 78 will prick the second bag 70, thus bursting it like a balloon. The function of the second bag 70 is also to increase spread of fire suppressant solution 86 when the first bag 62 bursts upon impact with the target.

One method of fabricating this targeting, small wildland fire extinguisher dropping system 10 is:

1. fabricating the housing 14;
2. fabricating the top plate 18;
3. cutting a hole 96 through the top plate 18;
4. attaching the top plate 18 to the top 22 of the housing;
5. fabricating the first bag 62;
6. fabricating the bottom plate 34;
7. hingeably attaching the bottom plate 34 to the bottom 30 of the housing;
8. fabricating a suspending mechanism 26;
9. attaching the suspending mechanism 26 to the housing 14;
10. attaching a latch 42 to the housing 14;
11. fabricating a latch release 46;
12. attaching the latch release 46 to the latch 42 and the housing 14;
13. fabricating a lid 58, which will fit inside the neck 66 of the bag 62, with a handle 132 and a filling port 116;
14. assembling the lid 58 inside the neck 66 of the bag 62;
15. fabricating a securing mechanism 50;
16. attaching the securing mechanism 50 to the top plate 18 adjacent the hole 96;
17. placing the bag 62 with its assembled lid 58 inside the housing 14 and inserting the neck/lid portion 94 through the hole 96 and into the securing mechanism 50;
18. retaining the neck/lid assembly 94 within the securing mechanism 50 with the desired pressure;
19. latching the bottom plate 34 in its closed position with the latch 42;
20. mixing a batch of fire suppressant solution 86;
21. filling the bag 62 with the fire suppressant solution 86 through the filling port 116;
22. providing a threaded closure 120, adapted to mate with the threads of the filling port 116; and
23. threading the closure 116 into the filling port 116.

If pressurization of the first bag 62 is desired, the method will further include:

24. providing a first valved port 120;
25. installing the first valved port 120 through the lid 58; and
26. pressurizing the inside of the bag 62 with compressed gas 188 through this first valved port 120.

If the second bag is necessary, the method will include:

27. providing a second valved port 130;
28. installing this second valved port 130 through the lid 58 prior to assembling the lid 58 inside the first neck 66;
29. attaching sharp point(s) 78 to the interior of the first bag 62 prior to assembling the lid 58 to the neck 66;
30. fabricating the second bag 70;
31. attaching the neck 74 of the second bag 70 to the interior portion 184 of the second valved port 130;
32. placing the second bag 70 inside the first bag 62 prior to assembling the lid 58 inside the first neck 66; and
33. pressurizing the second bag 70 with compressed gas 188 through the second valved port 130 after the threaded closure 120 has been threaded into the filling port 116.

If it is necessary to stir the solution 86 in the first bag 62 after the targeting, small wildland fire extinguisher dropping system 10 has been fully assembled, it will be necessary to:

34. remove the closure 120 from the threaded opening 116;
35. insert the stirrer 180 into the first bag 62 through the threaded hole 116; and
36. stir the solution 86 for a time sufficient to make it homogeneous again.

If a second bag 70 is installed inside the first bag 62, it may be necessary to cant the threaded opening 116 so that the stirrer 180 clears the second bag 70.

The following reference numerals are used on FIGS. 1 through 8:

10 Targeting, small wildland fire extinguisher dropping system
14 Housing
18 Top plate
22 Top of housing
26 Suspending mechanism
30 Bottom of housing
34 Bottom plate
38 Hinge
42 Latch
46 Latch opening mechanism
50 Securing mechanism
54 Bag/lid assembly
58 Lid
62 First bag
66 Neck of first bag
70 Second bag
74 Neck of second bag
78 Sharp point
82 Inside of first bag
86 Fire suppressant solution
94 Neck/lid portion of bag/lid assembly
96 Opening in top plate
100 Annular grooves
104 Circumference of lid
108 Thermosetting adhesive
112 Shrink fit band
116 Filling port
120 Port closure
124 Optional holes through lid
128 First gas filling valve
130 Second gas filling valve
132 Handle
140 First metal extrusion
144 Second metal extrusion
148 Elastomer band
152 Tightening screw
156 Tightening direction
160 Bulging direction
164 Strap
168 Rim of drum
172 Cross strap
176 Hangar bar
180 Propeller
184 Inner portion of second valve
188 Compressed gas The targeting, small wildland fire extinguisher dropping system 10 has been described with reference to particular embodiments. Other modifications and enhancements can be made without departing from the spirit and scope of the claims that follow.

What is claimed is:

1. A targeting, small wildland fire extinguisher dropping system comprising:

a a housing having a top and a bottom;

b a top plate being across said top; said bottom being open; said top plate having a hole there through;

c a bottom plate, adapted to close said housing, hingeably attached to said bottom of said housing;

d a latch means for releasably latching said bottom plate in a closed position, attached to said housing;

e a first bag made of pliable material, adapted to contain fire suppressant solution, fit snugly inside said housing when full of said fire suppressant solution and said bottom plate is latched closed, slide out of said housing when full of said fire suppressant solution and said bottom plate is open, and burst when it hits the ground full of said fire suppressant solution and dropped from a height; said first bag having a first neck; said first neck adapted to closely fit inside said hole;

f a quantity of said fire suppressant solution inside said first bag;

g a suspending means for suspending said housing, attached to said housing;

h a latch release means moveably attached to said latch and said housing for operating said latch;

i a lid, adapted to fit inside said first neck, inside said first neck; said lid having a threaded loading port through it;

j a handle affixed to said lid;

k a threaded closure, adapted to be inserted and removed from said threaded loading port, threaded into said threaded loading port;

l an assembling means for securely assembling said lid inside said first neck; and m a securing means, attached to said top plate adjacent said hole, for holding said first neck/lid assembly inside said hole; said securing means designed to hold said first neck/lid assembly within said hole when said first bag is full of fire suppressant solution and said bottom plate is latched closed and to release said first neck/lid assembly when first bag is full of fire suppressant solution and said bottom plate is open.

2. A targeting, small wildland fire extinguisher dropping system as claimed in claim 1 further comprising:

a a first valved port, passing through said lid, whereby the inside of said first bag can be pressurized with compressed gas; and b pressurized gas inside said first bag.

3. A targeting, small wildland fire extinguisher dropping system as claimed in claim 2 further comprising:

a second valved port passing through said lid; said second valve port having an interior portion and an exterior portion;

b a second bag made of pliable material, smaller than said first bag located inside said first bag; said second bag having a second neck; said neck being attached to said interior portion so that said second bag can be pressurized with compressed gas through said second valved port;

c pressurized gas inside said second bag; and d a sharp point attached to the interior of said first bag so that said sharp point will burst said second bag when said first bag impacts the ground.

4. A targeting, small wildland fire extinguisher dropping system as claimed in claim 3 further comprising a stirring means adapted to be inserted into said first bag through said threaded opening for stirring said fire suppressant solution and in which said threaded opening is adapted to allow said stirring means to clear said second bag.

5. A targeting, small wildland fire extinguisher dropping system as claimed in claim 2 further comprising a stirring means adapted to be inserted into said first bag through said threaded opening for stirring said fire suppressant solution.

6. A targeting, small wildland fire extinguisher dropping system as claimed in claim 1 further comprising:

a second valved port passing through said lid; said second valve port having an interior portion and an exterior portion;

b a second bag made of pliable material, smaller than said first bag located inside said first bag; said second bag having a second neck; said neck being attached to said interior portion so that said second bag can be pressurized with compressed gas through said second valved port;

c pressurized gas inside said second bag; and d a sharp point attached to the interior of said first bag so that said sharp point will burst said second bag when said first bag impacts the ground.

7. A targeting, small wildland fire extinguisher dropping system as claimed in claim 6 further comprising a stirring means adapted to be inserted into said first bag through said threaded opening for stirring said fire suppressant solution and in which said threaded opening is adapted to allow said stirring means to clear said second bag.

8. A targeting, small wildland fire extinguisher dropping system as claimed in claim 1 further comprising a stirring means adapted to be inserted into said first bag through said threaded opening for stirring said fire suppressant solution.

9. A targeting, small wildland fire extinguisher dropping system as claimed in claim 8 further comprising:

a a first valved port, passing through said lid, whereby the inside of said first bag can be pressurized with compressed gas; and b pressurized gas inside said first bag.

10. A method of fabricating a targeting, small wildland fire extinguisher dropping system comprising the steps of:

a fabricating a housing having an open top and an open bottom;

b fabricating a top plate adapted to close said top;

c cutting a hole through said top plate;

d attaching said top plate to said top;

e providing a bottom plate, adapted to close said housing;

f hingeably attaching said bottom plate to said bottom of said housing;

g providing a latch means for releasably latching said bottom plate in a closed position;

h attaching said latch means to said housing;

i fabricating a first bag of pliable material having a first neck; said first bag adapted to contain fire suppressant solution, fit snugly inside said housing when full of said fire suppressant solution and said bottom plate is latched closed, slide out of said housing when full of said fire suppressant solution and said bottom plate is open, and burst when it hits the ground full of said fire suppressant solution and dropped from a height; said first neck adapted to closely fit inside said hole;

j providing a suspending means for suspending said housing;

k attaching said suspending means to said housing;

l providing a latch release means for operating said latch;

m moveably attaching said latch release means to said latch and said housing;

n providing a lid, adapted to fit inside said first neck;

o cutting a threaded filling port through said lid;

p a providing a handle;

q attaching said handle to said lid;

r providing an assembling means for securely assembling said lid inside said first neck;

s assembling said lid inside said first neck with said assembling means;

t providing a securing means for holding said first neck/lid assembly inside said hole; said securing means designed to hold said first neck/lid assembly within said hole when said first bag is full and said bottom plate is latched closed and to release said first neck/lid assembly when first bag is full and said bottom plate is open;

u attaching said securing means to said top plate adjacent said hole;

v placing said first bag with its assembled lid and assembling means inside said housing;

w attaching said first neck/lid assembly to said securing means;

x latching said bottom plate in its closed position with said latch;

y providing fire suppressant solution;

z filling said first bag with said fire suppressant solution through said filling port;

aa providing a threaded closure, adapted to mate with the threads of said filling port; and bb threading said closure into said filling port.

11. A method of fabricating a targeting, small wildland fire extinguisher dropping system as claimed in claim 10 further comprising the steps of:

a providing a first valved port;

b installing said first valved port through said lid; and c pressurizing the inside of said first bag with compressed gas through said first valved port.

12. A method of fabricating a targeting, small wildland fire extinguisher dropping system as claimed in claim 11 further comprising the steps of:

a providing a stirring means adapted to be inserted into said first bag through said threaded opening for stirring said fire suppressant solution; and b inserting said stirring means into said first bag through said threaded hole.

13. A method of fabricating a targeting, small wildland fire extinguisher dropping system as claimed in claim 11 further comprising the steps of:

a providing a second valved port; said second valve port having an interior portion and an exterior portion;

b installing said second valved port through said lid prior to assembling said lid inside said first neck with said assembling means;

c providing a sharp point;

d attaching said sharp point to the interior of said first bag prior to assembling said lid to said first neck;

e providing a second bag made of pliable material, smaller than said first bag; said second bag having a second neck;

f attaching said neck to said interior portion; and g placing said second bag inside said first bag prior to assembling said lid inside said first neck with said assembling means; and h pressurizing said second bag with compressed gas through said second valved port after said threaded closure has been threaded into said filling port; said sharp point being located inside said first bag so that it will burst said second bag when said first bag impacts the ground.

14. A method of fabricating a targeting, small wildland fire extinguisher dropping system as claimed in claim 13 further comprising the steps of:

a providing a stirring means adapted to be inserted into said first bag through said threaded opening for stirring said fire suppressant solution; and b inserting said stirring means into said first bag through said threaded hole; said threaded opening adapted to allow said stirring means to clear said second bag.

15. A method of fabricating a targeting, small wildland fire extinguisher dropping system as claimed in claim 10 further comprising the steps of:

a providing a second valved port; said second valve port having an interior portion and an exterior portion;

b installing said second valved port through said lid prior to assembling said lid inside said first neck with said assembling means;

c providing a sharp point;

d attaching said sharp point to the interior of said first bag prior to assembling said lid to said first neck;

e providing a second bag made of pliable material, smaller than said first bag; said second bag having a second neck;

f attaching said neck to said interior portion; and g placing said second bag inside said first bag prior to assembling said lid inside said first neck with said assembling means; and h pressurizing said second bag with compressed gas through said second valved port after said threaded closure has been threaded into said filling port; said sharp point being located inside said first bag so that it will burst said second bag when said first bag impacts the ground.

16. A method of fabricating a targeting, small wildland fire extinguisher dropping system as claimed in claim 15 further comprising the steps of:

a providing a stirring means adapted to be inserted into said first bag through said threaded opening for stirring said fire suppressant solution; and b inserting said stirring means into said first bag through said threaded hole; said threaded opening adapted to allow said stirring means to clear said second bag.

17. A method of fabricating a targeting, small wildland fire extinguisher dropping system as claimed in claim 10 further comprising the steps of:

a providing a stirring means adapted to be inserted into said first bag through said threaded opening for stirring said fire suppressant solution; and b inserting said stirring means into said first bag through said threaded hole.

18. A method of fabricating a targeting, small wildland fire extinguisher dropping system as claimed in claim 17 further comprising the steps of:

a providing a first valved port;

b installing said first valved port through said lid; and c pressurizing the inside of said first bag with compressed gas through said first valved port.

* * * * *